US009561653B2

(12) United States Patent
Tuttnauer et al.

(10) Patent No.: US 9,561,653 B2
(45) Date of Patent: Feb. 7, 2017

(54) PRINTHEAD ARRANGEMENT ON A PRINTBAR BEAM MEMBER

(71) Applicant: Hewlett-Packard Industrial Printing LTD., Fort Collins, CO (US)

(72) Inventors: Ron Tuttnauer, Netanya (IL); Alex Veis, Kadima (IL)

(73) Assignee: Hewlett-Packard Industrial Printing LTD., Netanya (IL)

( * ) Notice: Subject to any disclaimer, the term of this patent is extended or adjusted under 35 U.S.C. 154(b) by 0 days.

(21) Appl. No.: 14/605,132

(22) Filed: Jan. 26, 2015

(65) Prior Publication Data

US 2015/0217566 A1 Aug. 6, 2015

(30) Foreign Application Priority Data

Jan. 31, 2014 (EP) ..... 14275019

(51) Int. Cl.
*B41J 2/155* (2006.01)
*B41J 2/14* (2006.01)

(52) U.S. Cl.
CPC ..... *B41J 2/1433* (2013.01); *B41J 2/155* (2013.01); *B41J 2202/20* (2013.01)

(58) Field of Classification Search
CPC ... B41J 2202/20; B41J 2/1404; B41J 2202/21; B41J 2/1433; B41J 2/145; B41J 2/2135; B41J 2/2146
USPC ..... 347/14, 40, 42, 45, 49
See application file for complete search history.

(56) References Cited

U.S. PATENT DOCUMENTS

| | | | | |
|---|---|---|---|---|
| 5,872,580 | A | 2/1999 | Ochi et al. | |
| 6,183,063 | B1 | 2/2001 | Bolash et al. | |
| 6,196,660 | B1 | 3/2001 | Park | |
| 6,328,418 | B1 * | 12/2001 | Yamada | B41J 2/15 347/12 |
| 6,966,627 | B2 * | 11/2005 | Escobedo et al. | 347/41 |
| 7,506,960 | B2 * | 3/2009 | Chikanawa et al. | 347/42 |
| 2004/0032452 | A1 | 2/2004 | Serra | |
| 2004/0261700 | A1 | 12/2004 | Edwards | |
| 2008/0110355 | A1 | 5/2008 | Chang | |
| 2010/0073424 | A1 | 3/2010 | Mills | |
| 2011/0157281 | A1 | 6/2011 | Lee et al. | |

FOREIGN PATENT DOCUMENTS

| | | | |
|---|---|---|---|
| EP | 1201432 | | 5/2002 |
| EP | 1795354 | A2 | 6/2007 |
| JP | H0781049 | A | 3/1995 |
| JP | 2000334951 | A | 12/2000 |

OTHER PUBLICATIONS

Hauser, C. et al.; "Rotational 3D Printing of Sensor Devices Using Reactive Ink Chemistries"; Sep. 24, 2008; http://utwired.engr.utexas.edu/Iff/symposium/proceedingsArchive/pubs/Manuscripts/2008/2008-28-Hauser.pdf.

* cited by examiner

*Primary Examiner* — Thinh H Nguyen
(74) *Attorney, Agent, or Firm* — HP Inc. Patent Department

(57) ABSTRACT

A printhead assembly includes a printbar beam member and a plurality of printheads disposed thereon. The printbar beam member includes a printbar longitudinal axis. Each one of the printheads includes a printhead longitudinal axis and a row of nozzles arranged parallel to the printhead longitudinal axis. The plurality of printheads are arranged on the printbar beam member in a manner in which each respective printhead longitudinal axis is traverse to the printbar longitudinal axis.

19 Claims, 7 Drawing Sheets

PRINTHEAD ARRANGEMENT ON A PRINTBAR BEAM MEMBER

CROSS-REFERENCE TO RELATED APPLICATION

This application claims foreign priority to European Patent Application No. 14275019.9, filed on Jan. 31, 2014 (EP Publication No. 2902206, published on Aug. 5, 2015) and entitled "PRINTHEAD ARRANGEMENT ON A PRINTBAR BEAM MEMBER," which is hereby incorporated by reference in its entirety.

BACKGROUND

A printhead assembly may include a printbar beam member and a plurality of printheads. The printheads may be spaced apart from each other along the printbar beam member. The printbar beam member may extend across a print zone and a width of media. The printheads may apply fluid onto media to form images thereon.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printers such as page wide presses may include printhead assemblies that include a printbar beam member and a plurality of printheads. The printbar beam member extends across a print zone including a width of media. The printheads may include a printhead native resolution. The printheads may be arranged on the printbar beam member in a manner that the printbar native resolution may be the same as a respective printhead native resolution. In general, printheads may be positioned in a manner that a row of nozzles are perpendicular to a media printing axis. A maximum resolution of a printed image printed by a printhead during one printing cycle may be limited to the printhead native resolution of the printhead. Accordingly, multiple printing cycles may be used to print an image on media having a resolution greater than the printhead native resolution. Increased printing cycles, however, may decrease printing throughput.

In examples, a printhead assembly includes a printbar beam member having a printbar longitudinal axis and a plurality of printheads. Each printhead includes a printhead longitudinal axis and a row of nozzles arranged parallel to the printhead longitudinal axis. The plurality of printheads are arranged on the printbar beam member in a manner in which each respective printhead longitudinal axis is traverse to the printbar longitudinal axis. Further, a portion of respective rows of the nozzles of adjacent printheads overlap each other with respect to the printbar longitudinal axis. Additionally, nozzles of the adjacent printheads are not arranged along a same line perpendicular to the printbar longitudinal axis. Accordingly, a printbar native resolution across the printbar beam member with the plurality of printheads disposed thereon is greater than a printhead native resolution of a respective printhead.

Accordingly, such a printhead arrangement may extend possible native resolutions which in turn can allow utilizing even higher print resolutions. Additionally, by increasing the printbar's native resolution, the number of print cycles is reduced and therefore throughput is increased. Also, less printheads per print cycles and printed region may be needed due to the increased printbar native resolution resulting in a reduction of cross-print placement errors and print artifacts.

Figure 1:
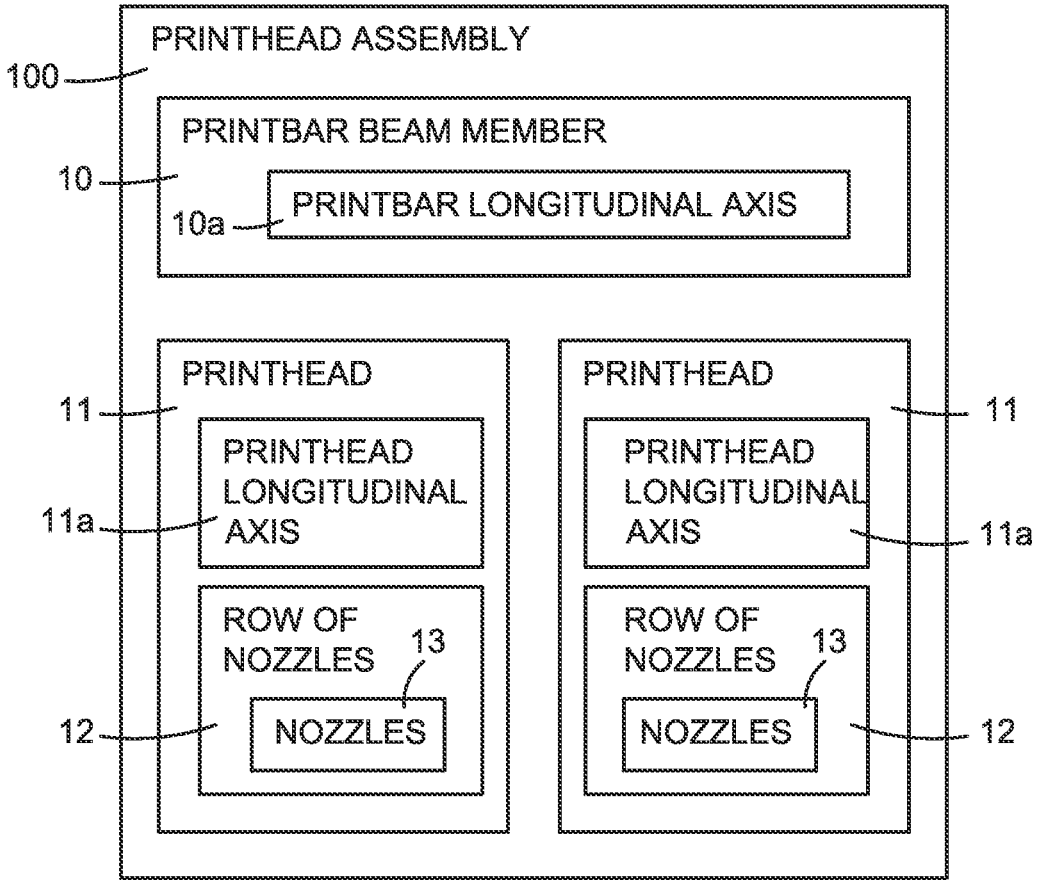
FIG. 1 is a block diagram illustrating a printhead assembly according to an example.

FIG. 1 is a block diagram illustrating a printhead assembly according to an example. Referring to FIG. 1, in some examples, a printhead assembly 100 includes a printbar beam member 10 and a plurality of printheads 11. The printbar beam member 10 includes a printbar longitudinal axis 10*a*. Each printhead 11 includes a printhead longitudinal axis 11*a* and a row 12 of nozzles 13 arranged parallel to the printhead longitudinal axis 11*a*. The plurality of printheads 11 are arranged on the printbar beam member 10 in a manner in which each respective printhead longitudinal axis 11*a* is traverse to the printbar longitudinal axis 10*a*. Further, a portion of respective rows 12 of the nozzles 13 of adjacent printheads 11 overlap each other with respect to the printbar longitudinal axis 10*a*. Additionally, nozzles 13 of the adjacent printheads 11 are not arranged along a same line perpendicular to the printbar longitudinal axis 10*a*.

Figure 2:
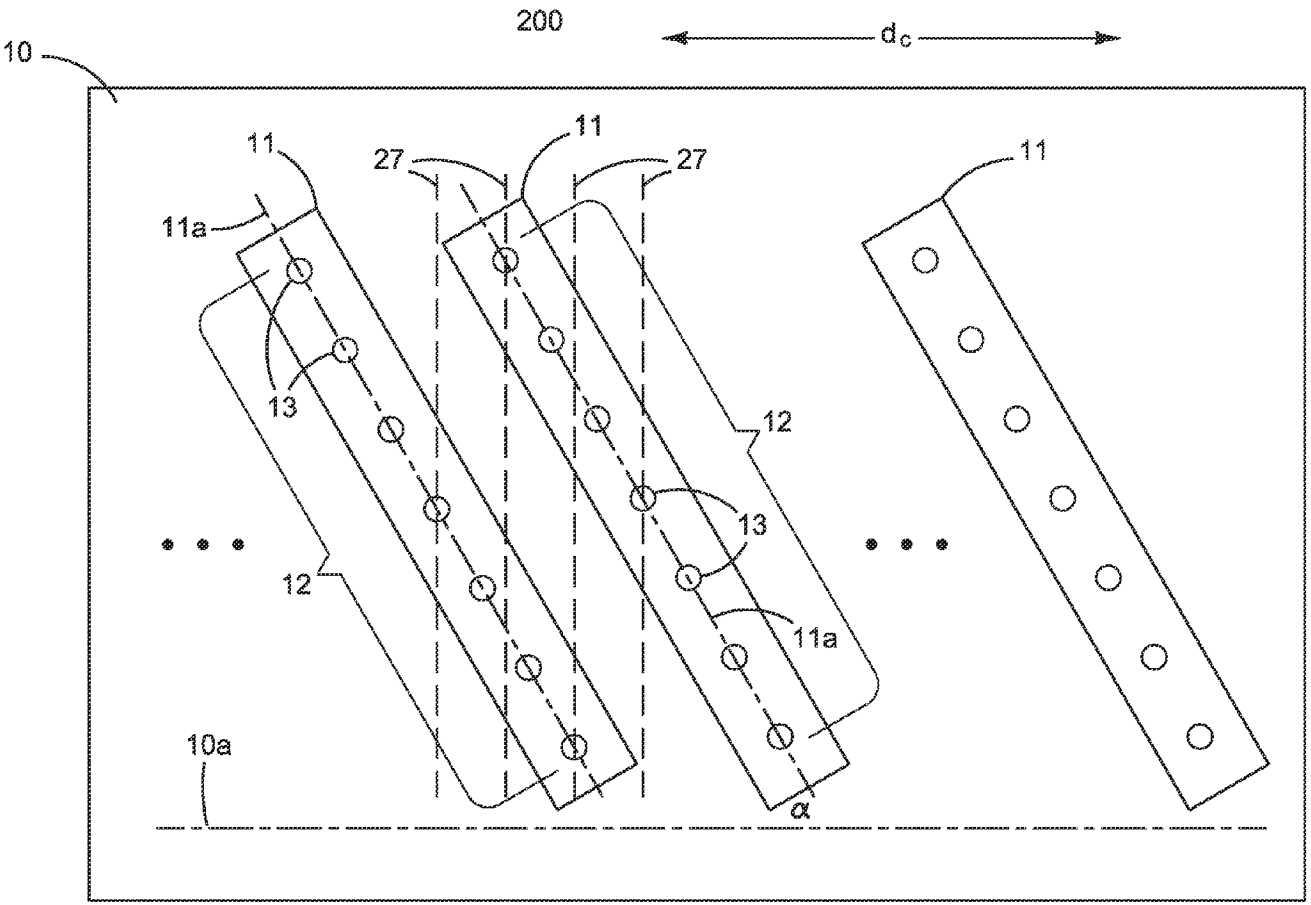
FIG. 2 is a schematic view illustrating a printhead assembly according to an example.
Figure 3:
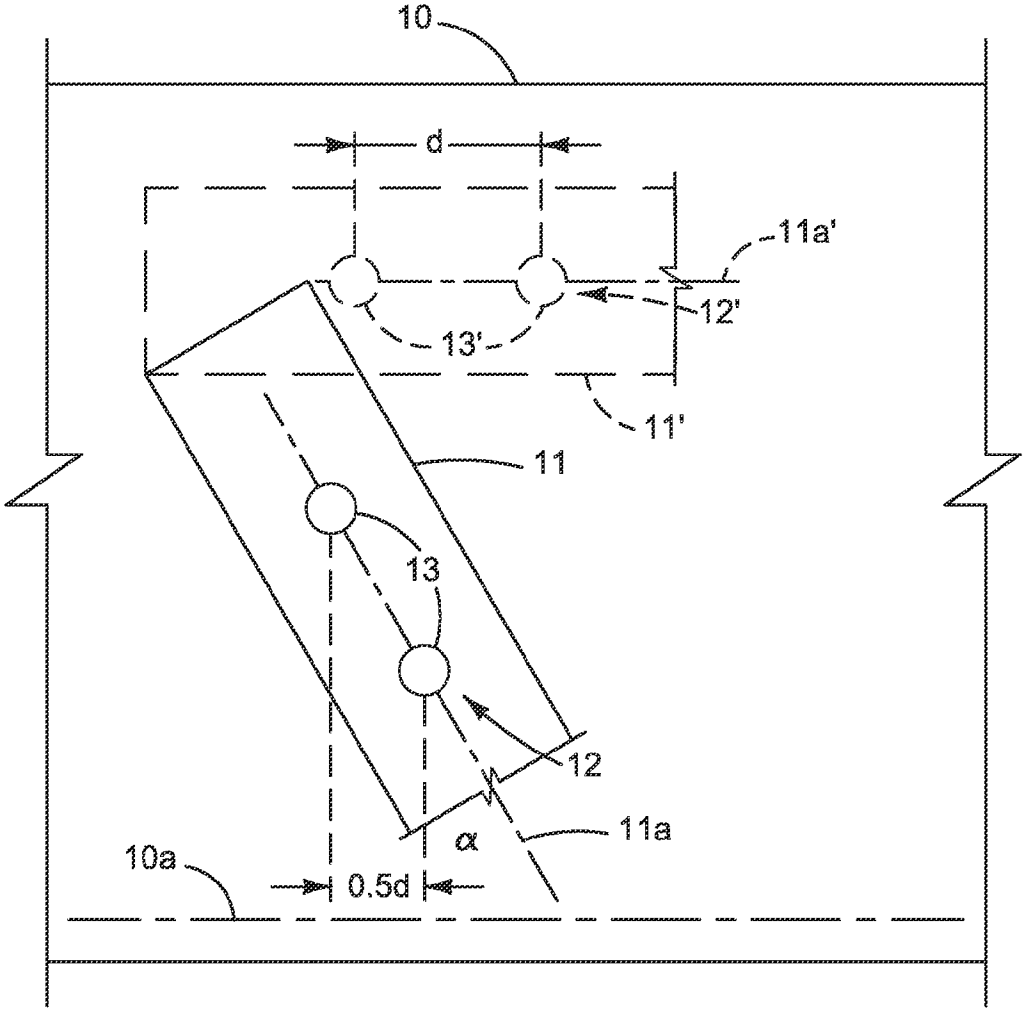
FIG. 3 is a schematic view illustrating the printhead assembly of FIG. 2 according to an example.

FIG. 2 is a schematic view illustrating a printhead assembly according to an example. FIG. 3 is a schematic view illustrating the printhead assembly of FIG. 2 according to an example. Referring to FIGS. 2-3, in some examples, the printhead assembly 200 includes the printbar beam member 10 and the plurality of printheads 11 as previously discussed with respect to FIG. 1. Each printhead 11 may include a printhead native resolution, a printhead longitudinal axis 11*a*, and a row 12 of nozzles 13. For example, the printhead native resolution is dependent on a pitch of respective nozzles 13 and a tilt angle $\alpha$ which corresponds to distance between nozzles of a nozzle arrangement projection on a longitudinal axis thereof. The resolution of an image printed on media by the respective printhead 11 may be dependent on the respective printhead native resolution.

Referring to FIGS. 2-3, in some examples, the printbar beam member 10 may include a printbar native resolution and a printbar longitudinal axis 10*a* extending in a cross-printing direction $d_c$. For example, the printbar native resolution corresponds to the distance between nozzles 13 arranged across the printbar beam member 10 in a respective direction $d_c$. The resolution of an image printed on media by a respective printbar beam member 10 may be dependent on the respective printbar native resolution. In some examples, the printbar native resolution across the printbar beam member 10 with the plurality of printheads 11 disposed thereon is greater than a printhead native resolution of a respective printhead 11.

Referring to FIGS. 2-3, in some examples, the plurality of printheads 11 may be arranged on the printbar beam member 10 in a manner in which each respective printhead longitudinal axis 11*a* is traverse to the printbar longitudinal axis 10*a*. That is, each respective printhead longitudinal axis 11*a* forms a tilt angle with the printbar longitudinal axis 10*a*. In other words, the printheads 11 are disposed on the printbar beam member 10 in a slanted (e.g., tilted) manner. In some examples, each respective printhead longitudinal axis 11*a* traverse to the printbar longitudinal axis 10*a* may form the tilt angle $\alpha$ therewith in a range from 5 degrees to 85 degrees including, for example, a range of about 60 degrees to about 71 degrees.

Referring to FIG. 3, for example, a respective printhead 11 is arranged on the printbar beam member 10 in a slanted manner with respect to the printbar longitudinal axis 10*a* and its printhead longitudinal axis 11*a* being traverse to the printbar longitudinal axis 10*a* at a tilt angle of about 60 degrees. Consequently, an effective distance d between the nozzles 13 of the row 12 of nozzles 13 with respect to the printbar longitudinal axis 10*a* is half the distance (e.g. 0.5 d) between nozzles 13' of a row 12' of nozzles 13' of a printhead 11' having a printhead longitudinal axis 11*a*' parallel to the printbar longitudinal axis 10*a*. Thus, the printhead native resolution of the printhead 11 is greater by arranging it in a slanted manner rather than in a non-slanted manner. Thus, nozzles of a nozzle arrangement projection with respect to a line parallel to the printbar longitudinal axis 10*a*

Additionally, referring to FIGS. 2-3, in some examples, a portion of respective rows 12 of the nozzles 13 of adjacent printheads 11 may overlap each other with respect to the printbar longitudinal axis 10*a*. Further, nozzles 13 of the adjacent printheads 11 are not arranged along a same line perpendicular 27 to the printbar longitudinal axis 10*a*. For example, at least a portion of the row 12 of nozzles 13 of one of the adjacent printheads 11 is below a portion of the row of nozzles 13 of another adjacent printhead 11 with respect to a perpendicular direction of the printbar longitudinal axis 10*a*. Further, respective nozzles of the overlapping portions of the rows 12 of nozzles 13 are offset from each other with respect to respective lines 27 perpendicular to the printbar longitudinal axis 10*a*. Thus, the respective nozzles 13 may be positioned to enable the printbar native resolution across the printbar beam member 10 with the plurality of printheads 11 disposed to be greater than a printhead native resolution of a respective printhead 11.

Figure 4:
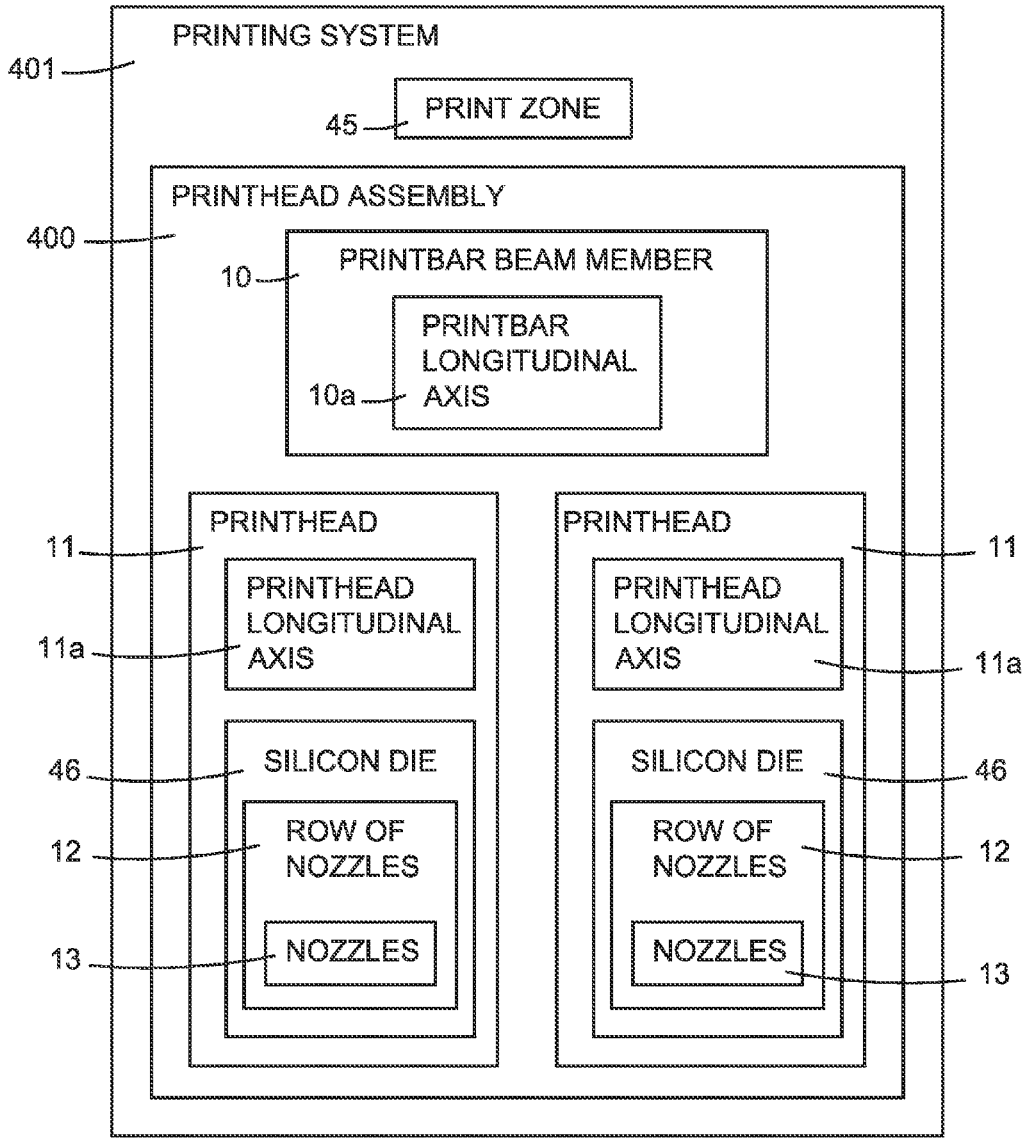
FIG. 4 is a block diagram illustrating a printing system according to an example.

FIG. 4 is a block diagram illustrating a printing system according to an example. Referring to FIG. 4, in some examples, a printing system 401 includes a print zone 45 and a printhead assembly 400. The print zone 45 may receive a media, for example to be printed on. The printhead assembly 400 includes a printbar beam member 10 and a plurality of printheads 41. The printbar beam member 10 includes a printbar longitudinal axis 10*a*, for example, extending across the print zone 45 in a cross-printing direction. Each printhead 41 includes a printhead longitudinal axis 11*a* and a plurality of silicon dies 46 arranged thereon. The plurality of printheads 41 are arranged on the printbar beam member 10 in a manner in which each respective printhead longitudinal axis 11*a* is traverse to the printbar longitudinal axis 10*a*. Each silicon die 46 includes a row 12 of nozzles 13 arranged parallel to the respective printhead longitudinal axis 11*a*. The respective silicon dies 46 on each printhead 41 are arranged in an offset arrangement with respect to each other.

Figure 5:
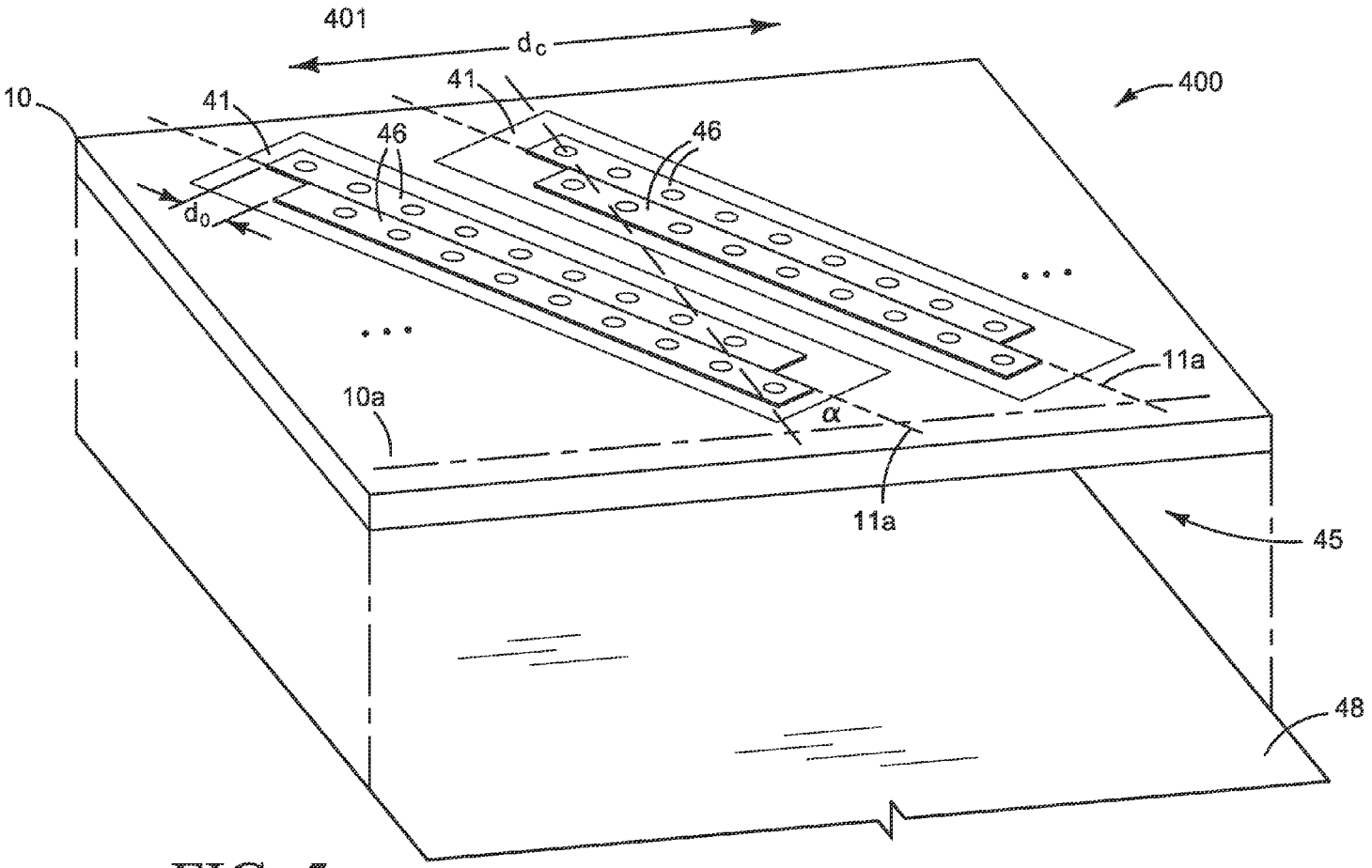
FIG. 5 is a schematic view illustrating the printing system of FIG. 4 according to an example.
Figure 6:
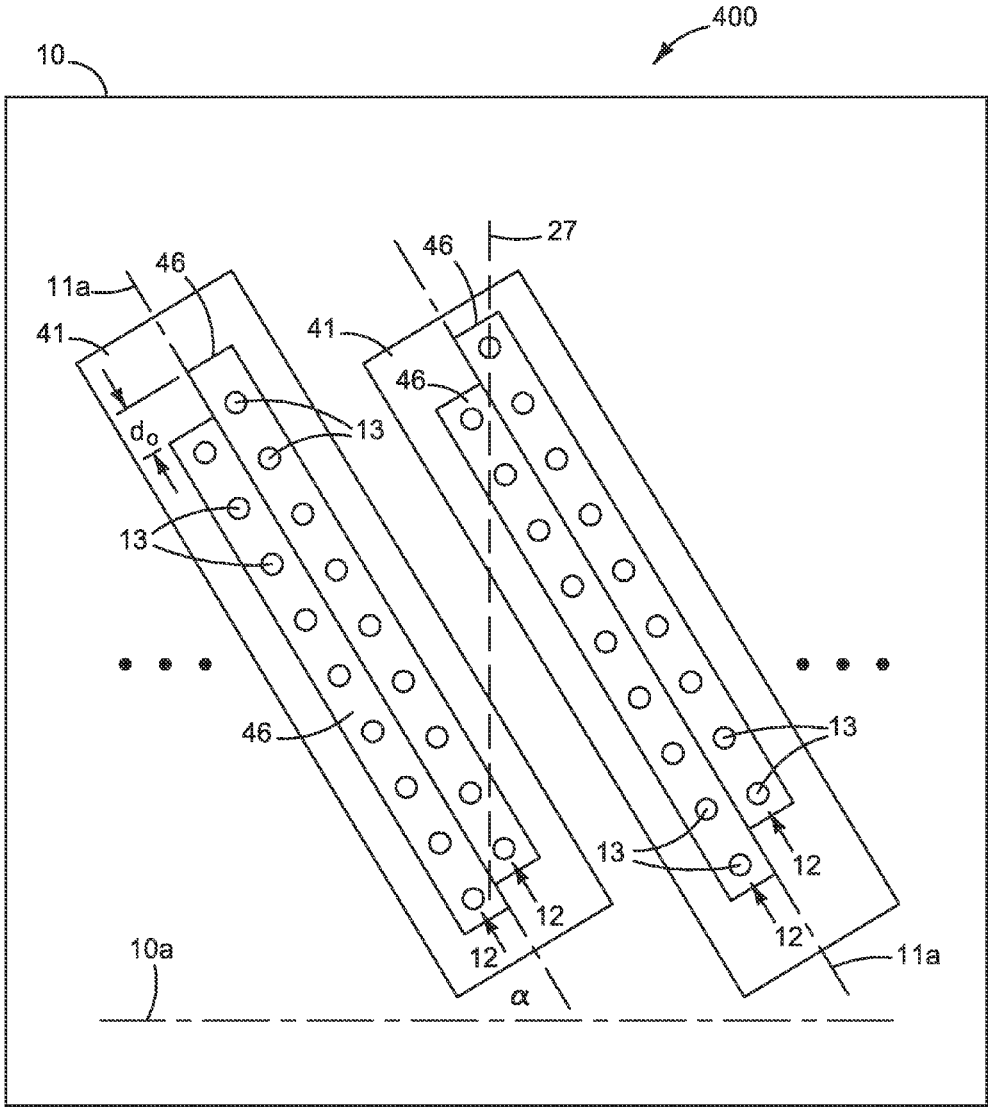
FIG. 6 is a schematic view illustrating a printhead assembly of the printing system of FIG. 5 according to an example.

FIG. 5 is a schematic view illustrating a printing system according to an example. FIG. 6 is a schematic view illustrating a printhead assembly of the printing system of FIG. 5 according to an example. Referring to FIGS. 5-6, in some examples, the printing system 401 includes the print zone 45 and the printhead assembly 400 as previously discussed with respect to FIG. 4. The print zone 45 may receive a media 48, for example, to be printed on. The printhead assembly 400 includes a printbar beam member 10 and a plurality of printheads 41. The printbar beam member 10 includes a printbar longitudinal axis 10*a*, for example, extending across the print zone 45 in a cross-printing direction $d_c$. Each printhead 41 includes a printhead longitudinal axis 11*a* and a plurality of silicon dies 46 arranged thereon.

Referring to FIGS. 5-6, in some examples, each silicon die 46 includes a row 12 of nozzles 13 arranged parallel to the respective printhead longitudinal axis 11*a*. The respective silicon dies 46 on each printhead 41 are arranged in an offset arrangement with respect to each other. In some examples, the respective silicon dies 46 are offset from each other by a predetermined distance $d_o$. For example, the predetermined distance $d_o$ may be based on an amount of tilt angle $\alpha$ that the respective printhead longitudinal axis 11*a* forms with the printbar longitudinal axis 10*a*. Additionally, respective nozzles 13 of adjacent printheads 41 are not arranged on a same line 27 perpendicular to the printbar longitudinal axis 10*a*.

Referring to FIGS. 5 and 6, in some examples, the plurality of printheads 41 are arranged on the printbar beam member 10 in a manner in which each respective printhead longitudinal axis 11*a* is traverse to the printbar longitudinal axis 10*a*. That is, each respective printhead longitudinal axis 11*a* forms a tilt angle $\alpha$ with the printbar longitudinal axis 10*a*. In other words, the printheads 11 are disposed on the printbar beam member 10 in a slanted manner. In some examples, each respective printhead longitudinal axis 11*a* traverse to the printbar longitudinal axis 10*a* may form a tilt angle $\alpha$ therewith in a range from about 60 degrees to about 71 degrees. As previously described with respect to FIG. 3, a respective printhead longitudinal axis 11*a* may form a tilt angle $\alpha$ with the printbar longitudinal axis of about 60 degrees.

In some examples, the predetermined distance $d_o$ of silicon dies offset from each other may be based on an amount of tilt angle that the respective printhead longitudinal axis forms with the printbar longitudinal axis. For example, adjacent silicon dies 46 of a respective printhead 11 may be offset from each other by an offset distance $d_o$ of about 2.4287 mm, for example, based on the printhead longitudinal axis 11*a* forming a tilt angle $\alpha$ of about 60 degrees with the printbar longitudinal axis 10*a*. Such an arrangement may extend the span of possible native resolutions which in turn can allow utilizing even higher print resolutions.

Referring to FIGS. 5-6, in some examples, a printbar native resolution across the printbar beam member 10 with the plurality of printheads 41 disposed thereon is greater than a printhead native resolution of a respective printhead 41. In some examples, the printbar native resolution across the printbar beam member 10 is at least double the respective printhead native resolution of the respective printhead 41. In some examples, the printbar native resolution across the printbar beam member 10 is at least four times the respective printhead native resolution of the respective printhead 41.

For example, the printheads 41 may be arranged such that the printhead longitudinal axis 10*a* forms a tilt angle α of about 60 degrees with the printbar longitudinal axis 10*a*, and nozzles 13 of adjacent printheads 11 may be interweaved with each other with respect to a respective direction. For example, portions of rows 12 of nozzles 13 of adjacent printheads 11 may overlap each other with respective to the printbar longitudinal axis 10*a*. In some examples, the plurality of printheads are inkjet printheads. A different color of ink may be ejected through each row 12 of nozzles 13 of a respective printhead 41. For example, each one of the different color ink is selected from at least one from the group consisting of black, cyan, magenta and yellow.

Figure 7:
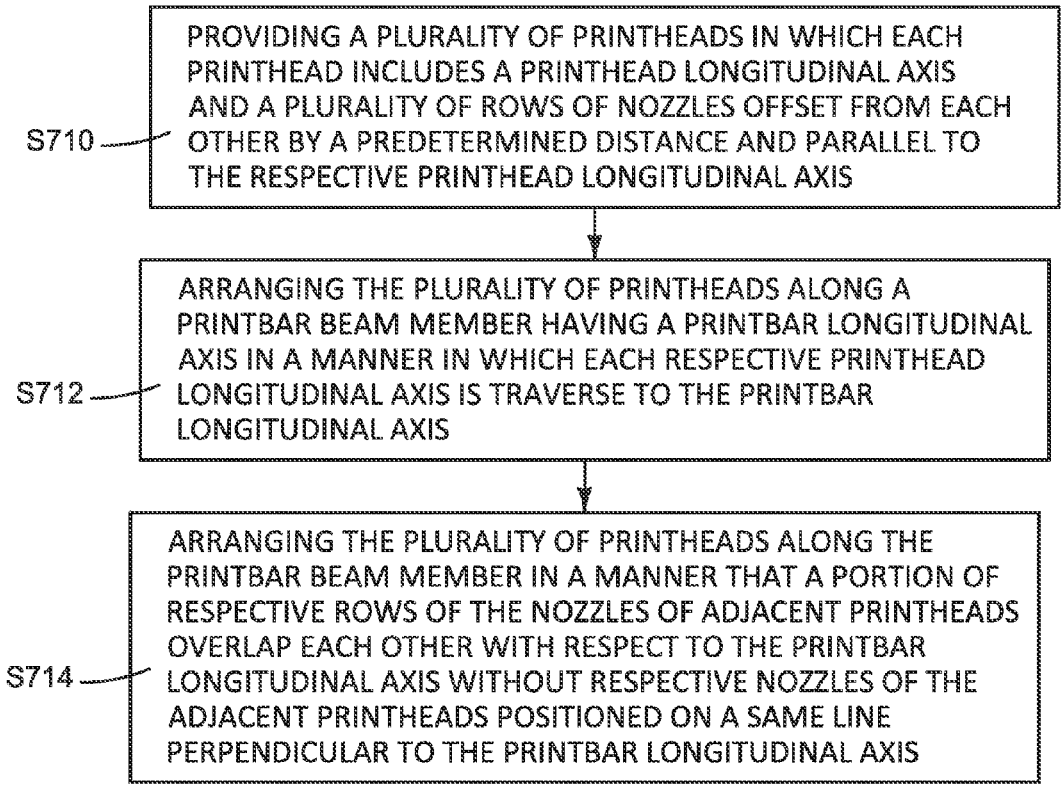
FIG. 7 is a flowchart illustrating a method of establishing a printbar native resolution across a printbar beam member having a plurality of printheads greater than a printhead native resolution of a respective printhead according to an example.

FIG. 7 is a flowchart illustrating a method of establishing a printbar native resolution across a printbar beam member having a plurality of printheads greater than a printhead native resolution of a respective printhead according to an example. In some examples, the assemblies and/or system implementing the method may be those described in relation to the printhead assemblies 100, 200, and 400 and printing system 401 of FIGS. 1-6. In block S710, the plurality of printheads are provided in which each printhead includes a printhead longitudinal axis and a plurality of rows of nozzles offset from each other by a predetermined distance and parallel to the respective printhead longitudinal axis. For example, the predetermined distance is based on an amount of tilt angle that the respective printhead longitudinal axis forms with the printbar longitudinal axis.

In block S712, the plurality of printheads are arranged along the printbar beam member having a printbar longitudinal axis in a manner in which each respective printhead longitudinal axis is traverse to the printbar longitudinal axis. In block S714, the plurality of printheads are arranged along the printbar beam member in a manner that a portion of respective rows of the nozzles of adjacent printheads overlap each other with respect to the printbar longitudinal axis without respective nozzles of the adjacent printheads positioned on a same line perpendicular to the printbar longitudinal axis. For example, the plurality of printheads may be arranged along the printbar beam member to at least double the respective printhead native resolution of the respective printhead. In some examples, arranging the plurality of printheads may include arranging the printheads such that each respective printhead longitudinal axis forms a tilt angle with the printbar longitudinal axis in a range from 5 degrees to 85 degrees including, for example, a range of about 60 degrees to about 70.5 degrees.

It is to be understood that the flowchart of FIG. 7 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 7 illustrates a specific order of execution, the order of execution may differ from that which is depicted. For example, the order of execution of two or more blocks may be rearranged relative to the order illustrated. Also, two or more blocks illustrated in succession in FIG. 7 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printhead assembly, comprising:

a printbar beam member having a printbar longitudinal axis;

a plurality of printheads in which each printhead includes a printhead longitudinal axis and a row of nozzles arranged parallel to the printhead longitudinal axis, the plurality of printheads are arranged on the printbar beam member in a manner in which each respective printhead longitudinal axis is traverse to the printbar longitudinal axis and a portion of respective rows of the nozzles of adjacent printheads overlap each other with respect to the printbar longitudinal axis; and wherein nozzles of the adjacent printheads are not arranged along a same line perpendicular to the printbar longitudinal axis; and wherein an effective distance between nozzles of a row with respect to the printbar longitudinal axis is half the distance of nozzles of a row of a printhead having a printhead longitudinal axis parallel to the printbar longitudinal axis.

2. The printhead assembly of claim 1, wherein a printbar native resolution across the printbar beam member with the plurality of printheads disposed thereon is greater than a printhead native resolution of a respective printhead.

3. The printhead assembly of claim 1, wherein the printbar longitudinal axis extends in a cross-printing direction.

4. The printhead assembly of claim 1, wherein the each respective printhead longitudinal axis traverse to the printbar longitudinal axis forms a tilt angle therewith in a range from about 60 degrees to about 71 degrees.

5. The printhead assembly of claim 1, wherein each printhead has a plurality of rows of nozzles.

6. The printhead assembly of claim 5, wherein the plurality of rows on a printhead are offset from each other.

7. The printhead assembly of claim 1, wherein nozzles of the adjacent printheads are interweaved with one another.

8. A printing system, comprising:

a print zone to receive a media; and a printhead assembly, including:

a printbar beam member having a printbar longitudinal axis extending across the print zone in a cross-printing direction; and a plurality of printheads in which each printhead includes a printhead longitudinal axis, each printhead includes a plurality of silicon dies arranged on each printhead in which the respective silicon dies are offset from each other such that each silicon die includes a row of nozzles arranged parallel to the respective printhead longitudinal axis; and wherein:

the plurality of printheads are arranged on the printbar beam member in a manner in which each respective printhead longitudinal axis is traverse to the printbar longitudinal axis; and respective nozzles of adjacent printheads are not arranged on a same line perpendicular to the printbar longitudinal axis; and wherein an effective distance between nozzles of a row with respect to the printbar longitudinal axis is half the distance of nozzles of a row of a printhead having a printhead longitudinal axis parallel to the printbar longitudinal axis.

9. The printing system of claim 8, wherein the respective silicon dies are offset from each other by a predetermined distance.

10. The printing system of claim 9, wherein the predetermined distance is based on an amount of tilt angle that the respective printhead longitudinal axis forms with the printbar longitudinal axis.

11. The printing system of claim 8, wherein a printbar native resolution across the printbar beam member with the plurality of printheads disposed thereon is greater than a printhead native resolution of a respective printhead.

12. The printing system of claim 8, wherein a different color of ink is ejected through each row of nozzles of a respective printhead.

13. The printing system of claim 12, wherein each one of the different color ink is selected from the group consisting of black, cyan, magenta and yellow.

14. The printing system of claim 8, wherein the offset is 2.4287 millimeters (mm).

15. A method of establishing a printbar native resolution across a printbar beam member having a plurality of printheads greater than a printhead native resolution of a respective printhead, the method comprising:

providing the plurality of printheads in which each printhead includes a printhead longitudinal axis and a plurality of rows of nozzles offset from each other by a predetermined distance and parallel to the respective printhead longitudinal axis, wherein an effective distance between nozzles of a row with respect to the printbar longitudinal axis is half the distance of nozzles of a row of a printhead having a printhead longitudinal axis parallel to the printbar longitudinal axis;

arranging the plurality of printheads along the printbar beam member having a printbar longitudinal axis in a manner in which each respective printhead longitudinal axis is traverse to the printbar longitudinal axis; and arranging the plurality of printheads along the printbar beam member in a manner that a portion of respective rows of the nozzles of adjacent printheads overlap each other with respect to the printbar longitudinal axis without respective nozzles of the adjacent printheads positioned on a same line perpendicular to the printbar longitudinal axis.

16. The method of claim 15, wherein the predetermined distance is based on an amount of tilt angle that the respective printhead longitudinal axis forms with the printbar longitudinal axis.

17. The method of claim 15, wherein the arranging the plurality of printheads along the printbar beam member in a manner that a portion of respective rows of the nozzles of adjacent printheads overlap comprises:

arranging the plurality of printheads along the printbar beam member to at least double the respective printhead native resolution of the respective printhead.

18. The method of claim 15, wherein the arranging the plurality of printheads along the printbar beam member having a printbar longitudinal axis in a manner in which each respective printhead longitudinal axis is traverse to the printbar longitudinal axis comprises:

arranging the plurality of printheads such that each respective printhead longitudinal axis forms a tilt angle with the printbar longitudinal axis in a range from 60 degrees to 70.5 degrees.

19. The method of claim 15, wherein the arranging the plurality of printheads along the printbar beam member in a manner that a portion of respective rows of the nozzles of adjacent printheads overlap comprises:

arranging the plurality of printheads along the printbar beam member to at least quadruple the respective printhead native resolution of the respective printhead.

* * * * *